US008948619B2

(12) United States Patent
Matsuda

(10) Patent No.: US 8,948,619 B2
(45) Date of Patent: Feb. 3, 2015

(54) IMAGE FORMING APPARATUS WHICH MEASURES TIME DURING WHICH AN IMAGE CARRIER CONTACTS A TONER CARRIER

(75) Inventor: Kohei Matsuda, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 940 days.

(21) Appl. No.: 13/083,376

(22) Filed: Apr. 8, 2011

(65) Prior Publication Data

US 2011/0255884 A1 Oct. 20, 2011

(30) Foreign Application Priority Data

Apr. 14, 2010 (JP) ..... 2010-093356

(51) Int. Cl.
*G03G 15/00* (2006.01)
*G03G 15/08* (2006.01)
*G03G 21/18* (2006.01)

(52) U.S. Cl.
CPC ..... *G03G 21/1825* (2013.01); *G03G 15/55* (2013.01); *G03G 15/556* (2013.01)
USPC ..... 399/26; 399/27; 399/43

(58) Field of Classification Search
USPC ..... 399/26, 27, 43
See application file for complete search history.

(56) References Cited

U.S. PATENT DOCUMENTS

2004/0076441 A1* 4/2004 Matsuguma et al. ..... 399/26

FOREIGN PATENT DOCUMENTS

| | | | |
|---|---|---|---|
| JP | 2002-214983 | A | 7/2002 |
| JP | 2003-323090 | A | 11/2003 |
| JP | 2009-009036 | A | 1/2009 |

* cited by examiner

*Primary Examiner* — Sophia S Chen
(74) *Attorney, Agent, or Firm* — Canon USA, Inc., IP Division

(57) ABSTRACT

An image forming apparatus includes an image carrier configured to carry an electrostatic latent image, a toner carrier configured to carry a toner and develop the electrostatic latent image, a switching member configured to perform a switching operation between a contact state where the toner carrier contacts the image carrier and a separation state where the toner carrier is separated from the image carrier, a first electrode member, a second electrode member arranged such that the electrostatic capacity between the first and second electrode members in the contact state is different from the electrostatic capacity therebetween in the separation state, a detection device configured to detect the electrostatic capacity between the first and second electrode members.

8 Claims, 10 Drawing Sheets

IMAGE FORMING APPARATUS WHICH MEASURES TIME DURING WHICH AN IMAGE CARRIER CONTACTS A TONER CARRIER

BACKGROUND OF THE INVENTION

1. Field of the Invention

The present invention relates to an image forming apparatus such as an electrophotographic copying machine and an electrophotographic printer.

2. Description of the Related Art

Until now, an image forming apparatus using an electrophotographic method has been known in which an image carrier is brought into contact with a toner carrier to develop an electrostatic latent image (referred to as a contact development method) on the image carrier, transferring the image onto a recording media. In some contact-development image forming apparatus, the toner carrier is brought into contact with the image carrier during a development period, and the toner carrier is separated from the image carrier during a non-development period to prevent wearing-down of the image carrier and deforming of the toner carrier.

Japanese Patent Application Laid-Open No. 2003-323090 discusses a method for measuring the time during which the image carrier is in contact with the toner carrier in a case where the toner carrier is brought into contact with or separated from the image carrier as described above. In Japanese Patent Application Laid-Open No. 2003-323090, the control unit of the main body of image forming apparatus starts and stops the measurement of the contact time by transmitting a contact and a separation signal to a contact and a separation unit in a predetermined timing, and detecting the contact and the separation signal.

Since the measured contact time is an index of measuring a wearing degree due to mechanical stress to which the image carrier is subjected by the toner carrier, a replacement timing of the image carrier can be determined or various image forming conditions such as a development bias, charging bias, or transfer bias can be changed based on the contact time, for example.

The above conventional image forming apparatus, however, may not accurately measure the actual contact time between the image carrier and the toner carrier due to the following reason.

The contact and separation units for the toner carrier and the image carrier are formed of a large number of components. Dimensions of components of each unit and driving motors for driving the contact and separation units have variation among a plurality of image forming apparatus. Among the image forming apparatus using the electrophotographic method, there exists an image forming apparatus equipped with a process cartridge in which a plurality of members is integrated and made detachable from the main body of image forming apparatus so that consumables such as an image carrier and a toner can be readily replaced. Such a process cartridge is also formed of a large number of components. Dimensions of components at portions where the contact and separation unit of the main body of image forming apparatus act on the process cartridge have variation among the process cartridges.

In an environment (such as temperature and humidity) in which the image forming apparatus is used or in a case where a intermittent printing is repetitively performed in particular, not only the dimensions of components have variation but also members forming the contact and separation unit of the main body of image forming apparatus can cause settling and wearing-down. Similarly, in the portions where the contact and separation unit of the main body of image forming apparatus acts on the process cartridge the settling and wear may occur. For this reason, an actual time required when the toner carrier is brought into contact with or separated from the image carrier, is changed depending on situations where the image forming apparatus is used.

Because of the above reason, a contact time measured based on the contact and separation signal transmitted from the control unit of the main body of image forming apparatus is different from the time during which the toner carrier actually contacts the image carrier. Particularly, this becomes conspicuous as a printing speed of the image forming apparatus is increasing and lifetime of consumables (the process cartridge) becomes longer in recent years.

SUMMARY OF THE INVENTION

According to present invention, the image forming apparatus performs a switching operation between a contact state where an image carrier contacts a toner carrier and a separation state where the image carrier is separated from the toner carrier, and can accurately measure the time during which the image carrier contacts the toner carrier.

According to an aspect of the present invention, an image forming apparatus includes an image carrier configured to carry an electrostatic latent image, a toner carrier configured to carry a toner and develop the electrostatic latent image, a switching member configured to perform a switching operation between a contact state where the toner carrier contacts the image carrier and a separation state where the toner carrier is separated from the image carrier, a first electrode member, a second electrode member configured to be arranged such that the electrostatic capacity between the first and second electrode members in the contact state is different from the electrostatic capacity therebetween in the separation state, a detection device configured to detect the electrostatic capacity between the first and second electrode members, and a measurement unit configured to perform the measurement of the time during which the image carrier contacts the toner carrier, wherein the measurement unit starts the measurement in response that the electrostatic capacity changes in excess of a predetermined value along with the switching operation from the separation state to the contact state, thereafter, the measurement unit stops the measurement in response that the electrostatic capacity changes in excess of a predetermined value along with the switching operation from the contact state to the separation state.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
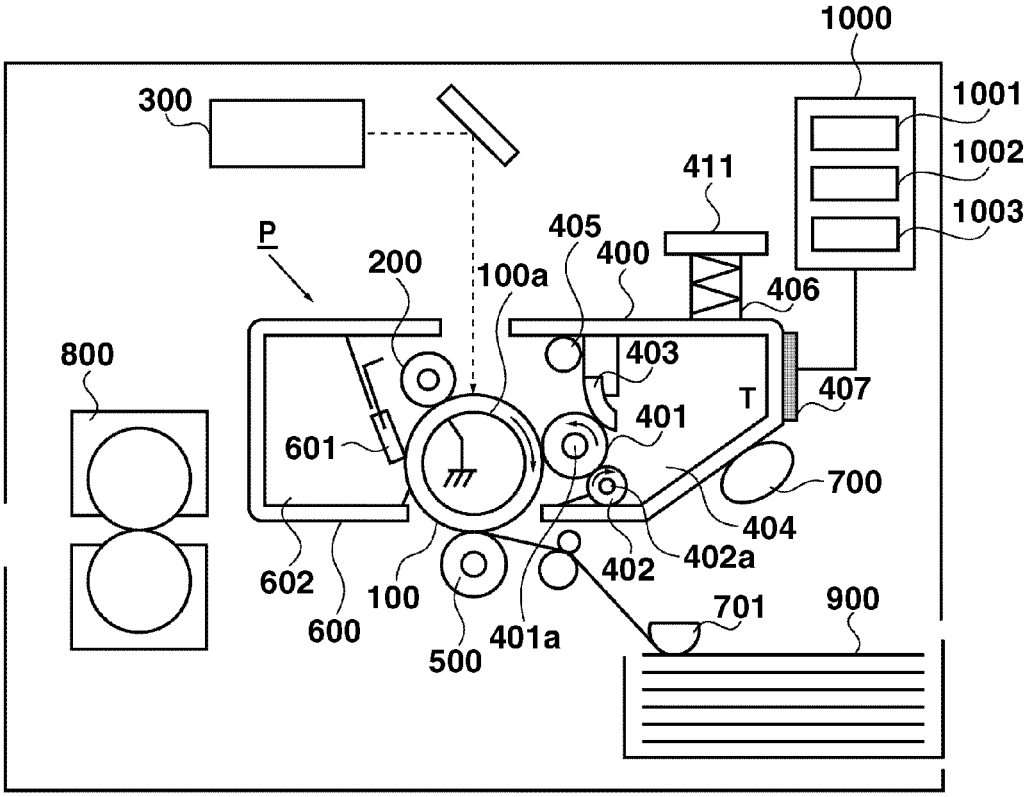
FIG. 1 is a schematic diagram illustrating a configuration of an image forming apparatus according to a first exemplary embodiment of the present invention.

A first exemplary embodiment of the present invention is described below. FIG. 1 is a schematic diagram of an image forming apparatus according to the first exemplary embodiment.

The image forming apparatus according to the first exemplary embodiment is an electrophotographic image forming apparatus which subjects a photosensitive drum to a series of image forming processes of charging, exposure, development, transfer, and cleaning to form an image on a recording medium.

The image forming apparatus executing the above series of the image forming processes includes a photosensitive drum 100 as an image carrier, a charging device 200 serving as a charging unit for uniformly charging the surface of the photosensitive drum 100, an latent image exposure device 300 for exposing the charged photosensitive drum 100 according to image data to form an electrostatic latent image, a development device 400 for causing a developing roller 401 serving as a toner carrier to contact the electrostatic latent image formed on the photosensitive drum 100 to visualize a toner image, a contact and separation member for causing the development device 400 to contact the photosensitive drum 100 and separating the development device 400 from the photosensitive drum 100, a transfer device 500 for transferring the developer image formed on the photosensitive drum 100 to a recording media 900, a fixing device 800 for fixing a toner image onto the recording media 900, and a cleaning device 600 for cleaning the surface of the photosensitive drum 100 after transfer.

The image forming apparatus according to the first exemplary embodiment includes a remaining-toner-amount detection unit for detecting the remaining amount of a toner T included in the development device 400. The remaining-toner-amount detection unit detects electrostatic capacity between the conductive core 401*a* of the developing roller 401 serving as the toner carrier forming a part of the development device 400 and the conductive core 402*a* of a supply roller 402 serving as a toner supply member by an electrostatic capacity detection device 410 as a detection device illustrated in FIG. 2 to detect the amount of remaining toner in the development device. The time during which the developing roller 401 actually contacts the photosensitive drum 100 (hereinafter referred to as a contact time) is measured based on the detection result from the electrostatic capacity detection device 410 in the switching operation between the state where the developing roller 401 contacts the photosensitive drum 100 (hereinafter referred to as a contact state) and the state where the developing roller 401 is separated from the photosensitive drum 100 (hereinafter referred to as a separation state). The term "contact state" also includes a state where the developing roller 401 contacts the photosensitive drum 100 via a toner and does not always refer to a state where the developing roller 401 contacts the photosensitive drum 100 not via a toner. The replacement timing of the photosensitive drum 100 is determined and the image forming condition is changed based on the contact time.

The image forming apparatus according to the first exemplary embodiment arranges the charging device 200, the latent image exposure device 300, the development device 400, the transfer device 500, and the cleaning device 600 on the periphery of the photosensitive drum 100 in this order.

The photosensitive drum 100 rotates in the direction R to form an image. The structure of the photosensitive drum 100 is such that an insulation layer, a carrier generation layer, and a carrier transport layer are formed on an aluminum cylinder as a conductive core in this order.

The charging device 200 contacts the photosensitive drum 100 and is driven and rotated by the photosensitive drum 100. A predetermined charging bias is applied to the charging device 200 to uniformly charge the photosensitive drum 100.

The latent image exposure device 300 scan-outputs the laser beam modulated according to an image signal. The latent image exposure device 300 irradiates the photosensitive drum 100 uniformly charged by the charging device 200 with the laser beam to form an electrostatic latent image.

The development device 400 includes a toner container 404, a developing roller 401, the supply roller 402, a developing blade 403, and toner T. The developing roller 401 is arranged at the opening of the toner container 404 for containing toner, contacts the photosensitive drum 100 in a predetermined timing, rotates at a peripheral speed ratio in the forward direction of the photosensitive drum 100 to perform a developing operation. The structure of the developing roller 401 is such that an elastic member such as semiconductive urethane rubber (not illustrated) is provided on the conductive core 401*a* as a first electrode member. The developing roller 401 carries and conveys the toner T. A predetermined developing bias is applied to the developing roller 401 and the electrostatic latent image is developed by the toner T. The toner T uses a nonmagnetic one-component developer. The supply roller 402 contacts the developing roller 401 and rotates at a predetermined peripheral speed ratio in the reverse direction of the developing roller 401. The structure of the supply roller 402 is such that an elastic member (not illustrated) such as urethane foam is provided on the conductive core 402*a* as a second electrode member. The supply roller 402 supplies the toner T to the developing roller 401. The developing blade 403 uses an elastic blade as a conductive supporting member and contacts the developing roller 401 at a predetermined pressing force to regulate the thickness of the toner T on the developing roller 401.

The recording media 900 such as paper is supplied and conveyed to the transfer device 500 by a paper feed roller 701 in synchronization with the formation of the electrostatic latent image on the photosensitive drum 100. A predetermined transfer bias is applied to the transfer device 500 to transfer the toner image on the photosensitive drum 100 onto the recording media 900. The recording media 900 onto which the toner image is transferred is conveyed to the fixing device 800, the toner image is permanently fixed thereon and then the recording media 900 is discharged outside the main body of the image forming apparatus.

A residual transfer toner remaining on the photosensitive drum 100 is removed by the cleaning device 600 using a cleaning blade 601 of an elastic blade and stored in a cleaning container 602.

The members used for the image forming apparatus wear down by the repetitive use of the image forming apparatus. In particular, a photosensitive drum and a toner are frequently eaten-up consumables. The image forming apparatus according to the first exemplary embodiment includes a process cartridge by which a worn consumable can be easily detached from the image forming apparatus or replaced.

In the first exemplary embodiment, the photosensitive drum 100, the charging device 200, the cleaning device 600, the toner T, and the development device 400 are integrated to form the process cartridge P. The process cartridge P further includes a swing center 405, a developing pressure member 406, and a memory 407 as a nonvolatile storage unit.

A control unit 1000 formed of the CPU for controlling the main body of the image forming apparatus includes a switching operation control unit 1001 for controlling a switching operation between the contact state and the separation state and a contact time measurement unit 1002 as a measuring unit for measuring a time period in the contact state (contact time). The contact time measurement unit 1002 measures the time during which the developing roller 401 contacts the photosensitive drum 100 based on the detection result output from the electrostatic capacity detection device 410 described later.

The above memory 407 stores information about the integrated value of the contact time measured by the contact time measurement unit 1002 in the image forming operation, a threshold value thereof, and a table for image forming conditions for the integrated value of the contact time. Owing to this configuration, if the power supply of the image forming apparatus is turned on or off, or if the process cartridge P is replaced, an extent that the photosensitive drum 100 wears down, becomes clear. This allows accurately or quickly determining replacement timing or changing the image forming conditions.

In the image forming apparatus of the first exemplary embodiment, all the operation timings at which the voltage for charging the photosensitive drum 100 is turned on or off or the developing roller 401 is contacted or separated are the same irrespective of the size of an image to be printed.

Figure 2A:
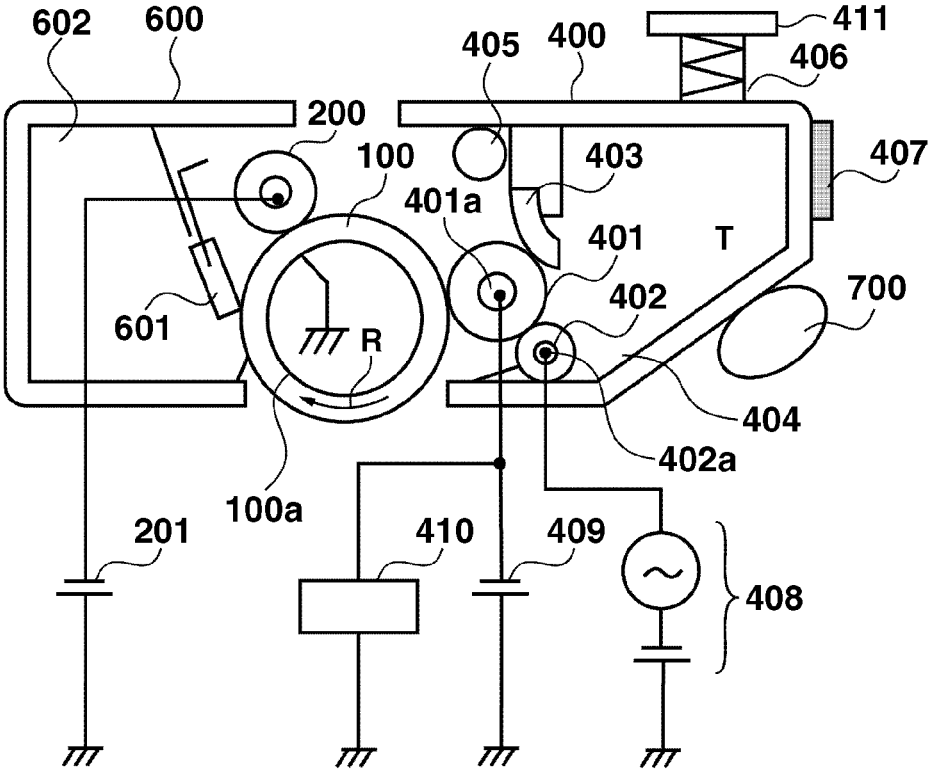
FIGS. 2A and 2B are schematic diagrams illustrating the contact state and separation state of a process cartridge according to the first exemplary embodiment of the present invention respectively.
Figure 2B:
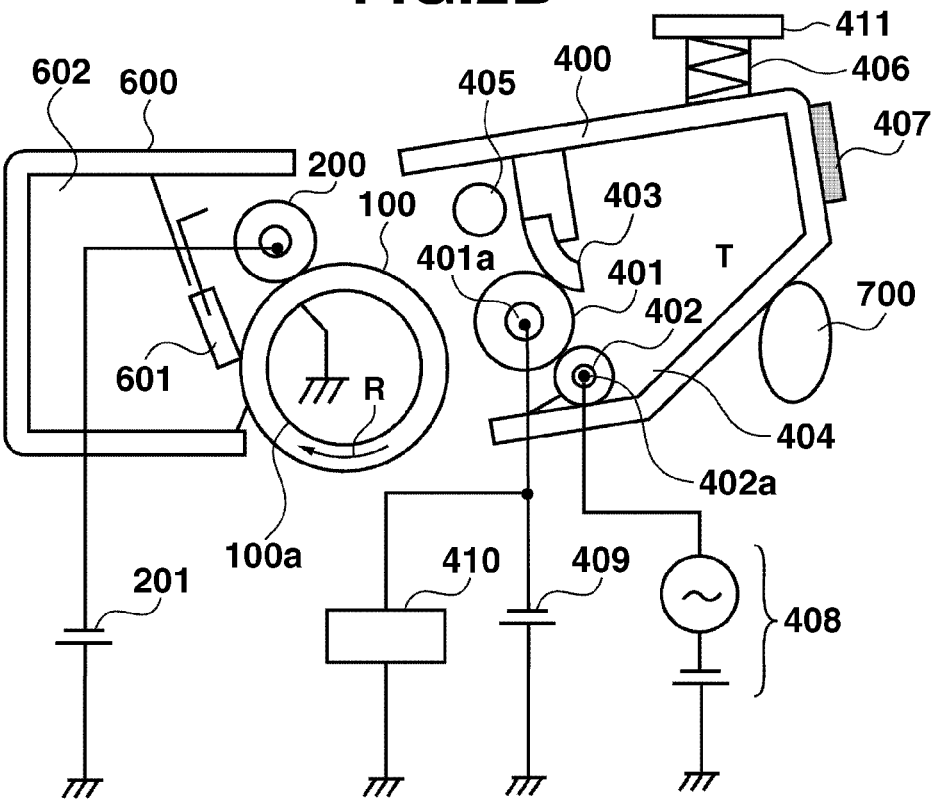

FIGS. 2A and 2B are schematic diagrams illustrating the contact state and the separation state of the process cartridge P. The developing roller 401 is supported by the toner container 404 and forms a part of the development device 400. The development device 400 can move between a contact position and a separation position. The development device 400 is provided with the swing center 405 and rotatable around the swing center 405. The development device 400 is made rotatable by the rotation operation of a cam 700 as a switching member for switching between the contact state and the separation state. The cam 700 can move between the contact position and the separation position. When the photosensitive drum 100 and the development device 400 are correctly mounted on the image forming apparatus and the cam 700 is located in the contact position, the development device 400 lies in the contact position, which brings the developing roller 401 into contact with the photosensitive drum 100. In the first exemplary embodiment, although the cam 700 is configured to move the development device 400, it is only necessary that the contact position and the separation position are movable, so that the present exemplary embodiment is not limited to the above configuration. Alternatively, the photosensitive drum 100 can be movable.

FIG. 2A is a schematic diagram illustrating the contact state where the developing roller 401 contacts the photosensitive drum 100. An image is formed in the contact state. The developing pressure member 406 of the development device 400 is compressed by a force receiving unit 411 of the image forming apparatus using a compression spring serving as an elastic member and provides the development device 400 with a moment with the swing center 405 as a center. The developing roller 401 contacts the photosensitive drum 100 by this moment with a predetermined pressure. The positions of the development device 400 and the cam 700 at this point are the contact position (image forming position).

FIG. 2B is a schematic diagram illustrating the separation state where the developing roller 401 does not contact the photosensitive drum 100 and is separated therefrom. The rotation of the cam 700 provides the development device 400 with a force greater than the force which the developing pressure member 406 gives to the development device 400. Thus, the development device 400 is rotated and moved with the swing center 405 as a center from the contact position to the separation position. Thereby, the developing roller 401 moves in the direction in which the developing roller 401 is separated from the photosensitive drum 100 to bring the developing roller 401 into noncontact with the photosensitive drum 100 and separate the developing roller 401 from the photosensitive drum 100. The positions of the development device 400 and the cam 700 at this point are the separation position. FIGS. 2A and 2B also illustrate the outline of electrical connection of the photosensitive drum 100 and the development device 400 as well as schematic diagrams illustrating the contact state and the separation state of the process cartridge P.

If the process cartridge P is correctly mounted on the image forming apparatus, the photosensitive drum 100 is grounded.

The charging device 200 is connected with a charging bias application device 201 charging a predetermined bias. The conductive core 402*a* of the supply roller 402 is connected to an electrostatic capacity detecting bias application device 408 regardless of whether the development device 400 is stopping at the contact position or at the separation position, or the development device 400 is performing a switching operation. The electrostatic capacity detecting bias application device 408 applies an electrostatic capacity detecting bias having at least an alternating current (AC) component to the conductive core 402*a*. Thereby, the electrostatic capacity detecting bias can be applied to the supply roller 402 at discretion regardless of whether the development device 400 is stopping at the contact position or at the separation position, or the development device 400 is performing a switching operation.

The conductive core 401*a* of the developing roller 401 is connected to a developing bias application device 409 for applying a predetermined direct current bias as the developing bias for forming an image and the electrostatic capacity detection device 410 regardless of whether the development device 400 is stopping at the contact position or at the separation position or the development device 400 is performing a switching operation. Thereby, the developing bias can be applied at discretion to the developing roller 401 regardless of whether the development device 400 is stopping at the contact position, or performing a contacting or separating operation. In addition, an electrostatic capacity can be detected.

When a predetermined electrostatic capacity detecting bias having at least an alternating current component is applied to the conductive core 402*a* of the supply roller 402, the electrostatic capacity detection device 410 detects the amount of the AC current flowing from the conductive core 401*a* of the developing roller 401 by electrostatic induction, so that the electrostatic capacity between the conductive cores 401*a* and 402*a* can be detected. The first exemplary embodiment uses a circuit in which a voltage reduced from a predetermined reference voltage V0 according to the detected amount of the AC current is taken as a detected voltage and is output to the control unit 1000 of the main body of the image forming apparatus. Specifically, the greater the electrostatic capacity between the conductive cores 401*a* and 402*a*, the greater the amount of the AC current induced in the core 401*a*, as a result the electrostatic capacity detection device 410 according to the first exemplary embodiment shows a smaller detected voltage. A reference voltage V0 represents a detection voltage output from the electrostatic capacity detection device 410 when the electrostatic capacity detecting bias is not applied.

In the first exemplary embodiment, the electrostatic capacity detection device 410 detects the remaining amount of a toner in the toner container 404. The larger the amount of the toner T between the developing roller 401 and the supply roller 402 is, the greater the electrostatic capacity between the cores 401*a* and 402*a* is. As a result, the amount of the AC current flowing from the core 401*a* increases, and the detected voltage shows smaller value. On the contrary, when the toner T is consumed by the image forming operation and the amount of the toner between the developing roller 401 and the supply roller 402 decreases, the electrostatic capacity between the cores 401*a* and 402*a* becomes smaller. As a result, the amount of the AC current flowing from the core 401*a* is decreased and the detected voltage shows greater value.

Therefore, the remaining amount of a toner can be detected by applying an electrostatic capacity detecting bias having at least an AC component to the conductive core 402*a* by the electrostatic capacity detecting bias application device 408, and detecting a voltage according to the AC current induced in the core 401*a* by the electrostatic capacity detection device 410.

The remaining amount of a toner can be basically detected regardless of whether the process cartridge P is in the contact state or the separation state. However the voltage detected by the electrostatic capacity detection device 410 is different between the contact state and the separation state. This is because in the contact state, the developing roller 401 contacts the photosensitive drum 100 to cause a part of the electrostatic capacity of the photosensitive drum 100 to affect the electrostatic capacity between the developing roller 401 and the supply roller 402 compared with in the separation state. It is useful to more accurately detect the remaining amount of a toner by performing the detection in either one of the contact state or the separation state. It is more useful that the detection is performed in the separation state to provide a larger amount of AC current when the equivalent electrostatic capacity detecting bias is applied, which desirably increases the sensitivity of detection of the remaining amount of a toner.

Figure 3A:
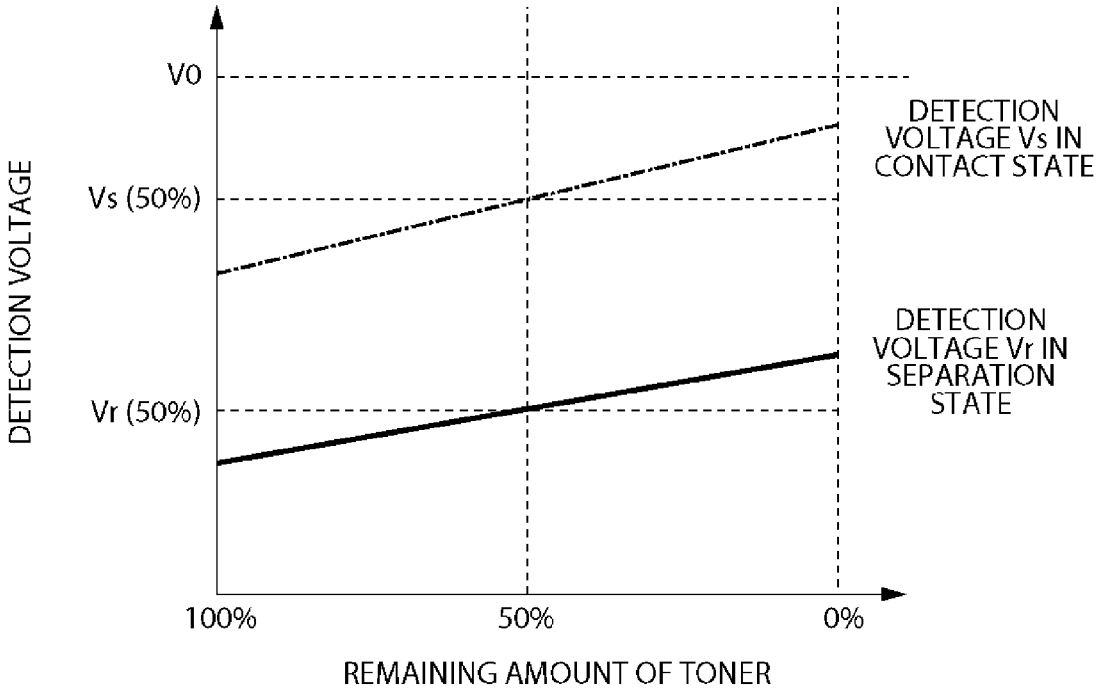
FIG. 3A is a schematic diagram indicating results detected by an electrostatic capacity detection device with respect to the remaining amount of a toner according to the first exemplary embodiment of the present invention.

FIG. 3A illustrates a relationship between the remaining amount of a toner in the toner container and detection voltage detected by the electrostatic capacity detection device 410. The solid line indicates a detected result Vr of a voltage detected by the electrostatic capacity detection device 410 in the separation position with respect to the remaining amount of a toner. An alternate long and short dash line indicates a detected result Vs of a voltage detected by the electrostatic capacity detection device 410 in the contact position with respect to the remaining amount of a toner. The applied electrostatic capacity detecting bias is a sine-wave AC voltage with a frequency of 50 kHz and an amplitude of 200 V. The remaining amount of a toner in a new process cartridge P is 100% and the remaining amount of the toner T which has been consumed until a solid image cannot be printed is 0%. V0 indicates reference voltage.

As illustrated in FIG. 3A, the detection voltages of the electrostatic capacity detection device 410, whether it is Vr detected in the separation position or Vs detected in the contact position, increase as the remaining amount of a toner decreases. This is because after the toner T is consumed, the electrostatic capacity between the developing roller 401 and the supply roller 402 decreases. The detection voltage Vs detected in the contact position is higher than the detected result Vr in the separation position. This is because parasitic capacitance is different between the contact position and the separation position. More specifically, that is because the electrostatic capacity detected between the developing roller 401 and the supply roller 402 in the contact state is smaller compared with the separation state due to the influence of the photosensitive drum 100.

The detection voltage of the electrostatic capacity detection device 410 detected in the contact position or the separation position correlates with the remaining amount of a toner. Therefore, the remaining amount of a toner in the process cartridge P can be detected from the voltage detected by the electrostatic capacity detection device 410 by storing a relationship between the voltage detected by the electrostatic capacity detection device 410 and the remaining amount of a toner in the memory 407*a* previously. In the first exemplary embodiment, although a relationship between the voltage detected by the electrostatic capacity detection device 410 and the remaining amount of a toner is stored in the memory 407 of the process cartridge P, the relationship may be stored in another storing unit of the main body of the image forming apparatus.

The following describes how to measure the time during which the developing roller 401 actually contacts the photosensitive drum 100 by the electrostatic capacity detection device 410.

Figure 3B:
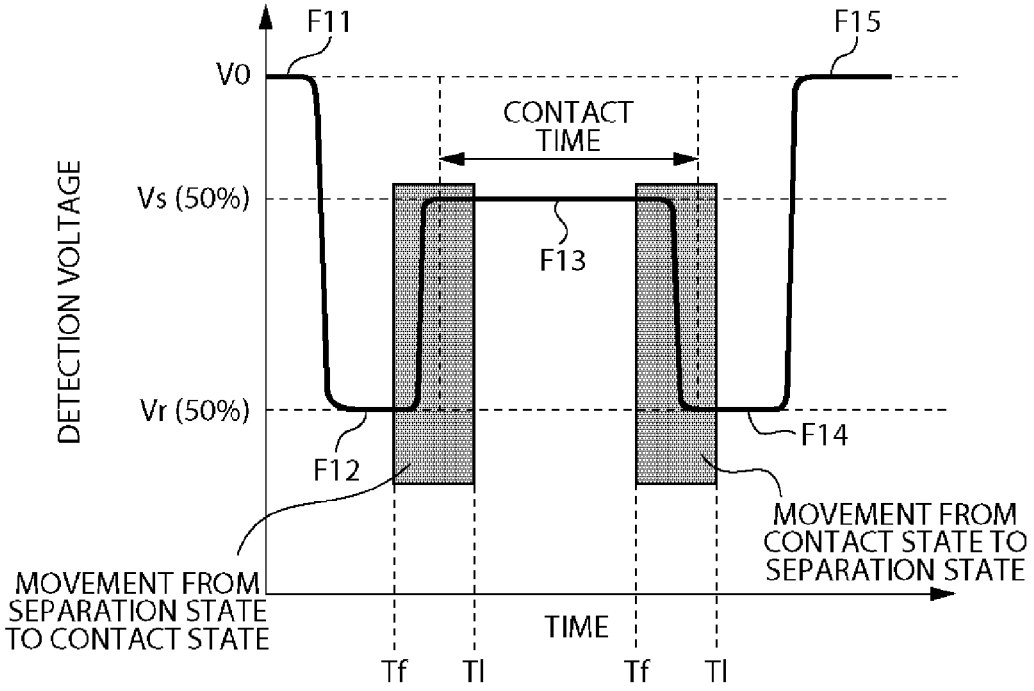
FIG. 3B is a schematic diagram indicating the measurement of a time during which a developing roller touches a photosensitive drum according to the first exemplary embodiment of the present invention.

FIG. 3B illustrates a change in results detected by the electrostatic capacity detection device 410 during the switching operation between the contact state and the separation state. Here, the remaining amount of a toner in the process cartridge P is 50% and the toner is not consumed. The applied electrostatic capacity detecting bias is a sine-wave AC voltage with a frequency of 50 kHz and the amplitude of 200 V.

When the electrostatic capacity detecting bias is not applied, the electrostatic capacity between the developing roller 401 and the supply roller 402 cannot be detected, so that the detection value is approximately equal to the reference voltage V0 (F11). When the electrostatic capacity detecting bias is applied, the value detected by the electrostatic capacity detection device 410 is approximately equal to the detection voltage Vr (50%) when the remaining amount of a toner is 50% and the development device 400 is in the separation position illustrated in FIG. 3A (F12). The cam 700 is driven, by applying the detecting bias as it is, to bring the developing roller 401 into the contact position. Then, the value detected by the electrostatic capacity detection device 410 is changed to the detection voltage Vs (50%) when the remaining amount of a toner is 50% in the contact position, from the detection voltage Vr (50%) when the remaining amount of a toner is 50% in the separation position illustrated in FIG. 3A (F13). The cam 700 is further driven from this state, by applying the detecting bias as it is, to bring the developing roller 401 into the separation position. Then, the value detected by the electrostatic capacity detection device 410 is changed to the detection voltage Vr (50%) when the remaining amount of a toner is 50% in the separation position, from the detection voltage Vs (50%) when the remaining amount of a toner is 50% in the contact position illustrated in FIG. 3A (F14). Then the electrostatic capacity detecting bias is turned off, the electrostatic capacity between the developing roller 401 and the supply roller 402 cannot be detected, so that the detection value becomes approximately equal to the reference voltage V0 (F15).

Thus, when the developing roller 401 is switched between the separation position and the contact position by applying the detecting bias as it is, the value detected by the electrostatic capacity detection device 410 changes rapidly. For this reason, the electrostatic capacity detection device 410 can determine whether the developing roller 401 is in the contact state or the separation state.

The time when the value detected by the electrostatic capacity detection device 410 is changed from the detection voltage Vr to the detection voltage Vs is taken as a start time (a time measurement starting point) in the contact process of the development device 400. The time when the value detected by the electrostatic capacity detection device 410 is changed from the detection voltage Vs to the detection voltage Vr is taken as a stop time (a time measurement ending point) in the separation process of the development device 400. Thus the time during which the developing roller 401 actually touches the photosensitive drum 100 can be measured.

The contact time measurement unit 1002 measures the time during which the developing roller 401 contacts the photosensitive drum 100 based on the amount of change in the value detected by the electrostatic capacity detection device 410 during the switching operation between the contact state and the separation state. More specifically, the contact time measurement unit 1002 starts measuring the contact time when an electrostatic capacity changes exceeding a predetermined value along with the switching operation, from the separation state to the contact state. After that, the contact time measurement unit 1002 stops measurement when an electrostatic capacity changes exceeding a predetermined value along with the switching operation, from the contact state to the separation state, thereby measuring the contact time. In the present exemplary embodiment, the contact time measurement unit 1002 starts measuring the contact time when the absolute value $|\Delta V|$ of amount of change detected by the electrostatic capacity detection device 410 exceeds the threshold Vth at the time of switching the separation state to the contact state. After that, the contact time measurement unit 1002 stops measurement when the absolute value $|\Delta V|$ exceeds again the threshold Vth at the time of switching the contact state to the separation state. In this case, the threshold Vth is desirably set to a value larger than the variation of value detected at the time of detecting the remaining amount of a toner. The threshold Vth is more desirably set to approximately the minimum value of the absolute value $|Vs-Vr|$, which is a difference between the detection voltage Vs in the contact position and the detection voltage Vr in the separation position in the range of 0% to 100% of the remaining amount of a toner. It is further more desirable to set the threshold Vth in consideration of variation of operating environment (temperature, humidity, and others) of the image forming apparatus and detection results. Thereby, the time during which the developing roller 401 actually contacts the photosensitive drum 100 can be measured in the contact and the separation process of the development device 400. In the present exemplary embodiment, although the same threshold Vth is used at the time of both starting and stopping measurement, a different threshold may be used at the time of starting and stopping measurement.

From the above results, when the electrostatic capacity detection device 410 capable of detecting the electrostatic capacity between the developing roller 401 and the supply roller 402 at the time of switching between the contact state and the separation state of the developing roller 401 and the supply roller 402, it can be determined whether the developing roller 401 actually contacts the photosensitive drum 100 irrespective of operating environment or the remaining amount of a toner. By utilizing the electrostatic capacity detection device 410, the time during which the developing roller 401 contacts the photosensitive drum 100 can be measured.

Specifically, the time during which the developing roller 401 contacts the photosensitive drum 100 can be accurately measured only by the electrostatic capacity detection device 410 for detecting the remaining amount of a toner without newly providing a sensor for detecting whether the developing roller 401 contacts the photosensitive drum 100 or is separated therefrom.

More specifically, the contact and the separation operation of the development device 400 is performed by the drive of the cam 700 receiving a contact and a separation signal transmitted from the switching operation control unit 1001. As described above, however, the dimension of a component forming the cam 700 and the process cartridge P has a considerable variation. Therefore, the time interval until the developing roller 401 actually contacts the photosensitive drum 100 after the contact signal is issued and the time interval until the developing roller 401 is actually separated from the photosensitive drum 100 after the separation signal is issued can be appreciably different among a plurality of the image forming apparatus and the process cartridges. As described above, the time interval greatly changes depending on the situation where the main body of the image forming apparatus is used.

For this reason, a time Tf when the developing roller 401 contacts fastest the photosensitive drum 100 and is separated fastest therefrom after the contact and the separation signal are issued respectively, and a time Tl when the developing roller 401 contacts latest the photosensitive drum 100 and is separated latest therefrom after the contact and the separation signal are issued respectively, are previously estimated in consideration of the dispersion of dimensions of these components. Application of the electrostatic capacity detecting bias is started earlier than Tf and electrostatic capacity detecting bias is turned off later than Tl. Thus, it can be surely determined whether the developing roller 401 contacts the photosensitive drum 100 or is separated from the photosensitive drum 100. Consequently, it is possible to more accurately measure the time during which the developing roller 401 contacts the photosensitive drum 100.

Figure 4:
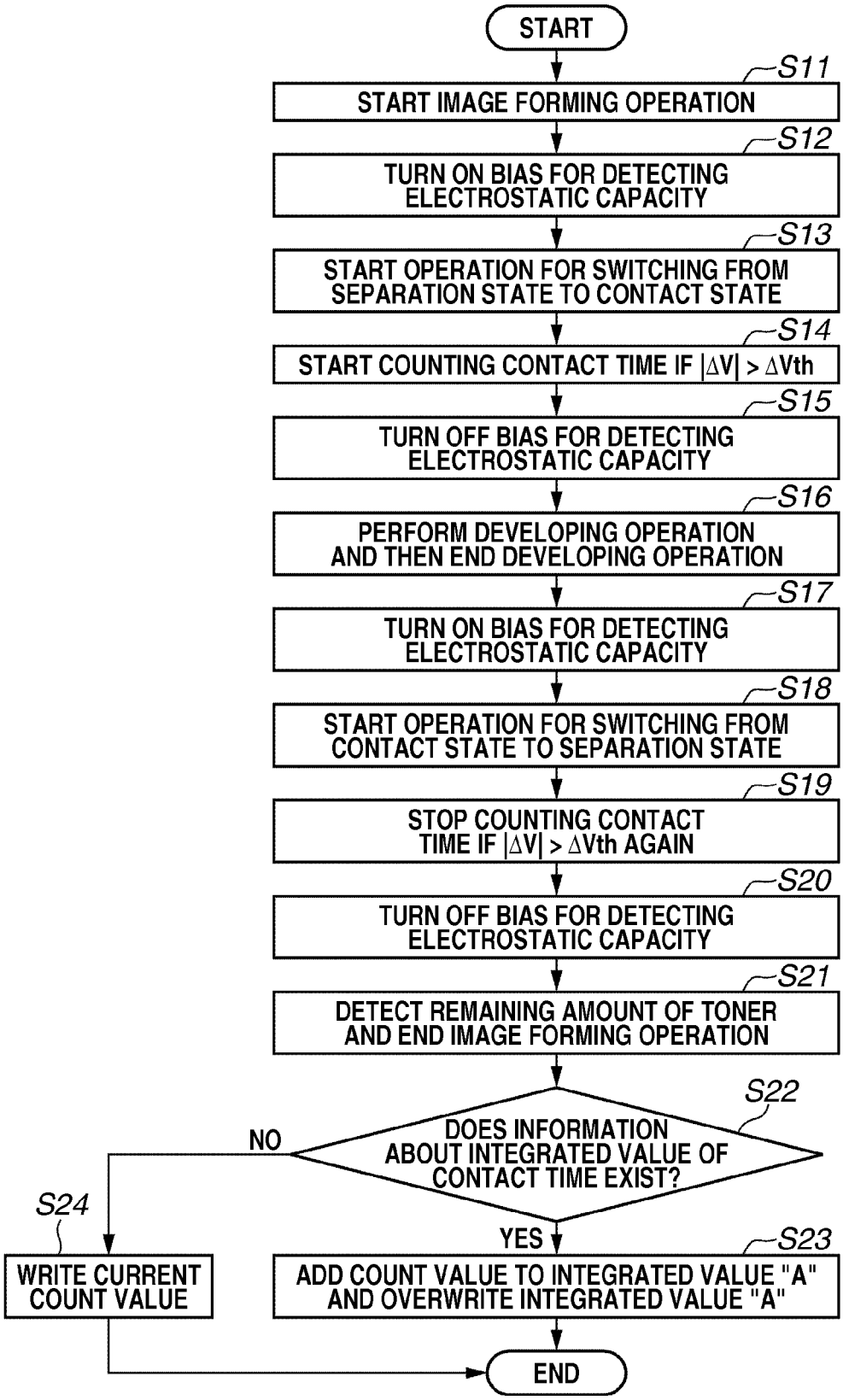
FIG. 4 illustrates a measurement sequence of a time during which the developing roller touches the photosensitive drum and the integrated value thereof according to the first exemplary embodiment of the present invention.

FIG. 4 illustrates a contact time measurement sequence of the photosensitive drum 100 according to the first exemplary embodiment. The control unit 1000 performs each process shown in the flow chart in FIG. 4 via the contact time measurement unit 1002 and the memory 407 of the process cartridge P to calculate accurately the contact time and the integrated value thereof.

In step S11, the image forming apparatus receives a print job, rotates the photosensitive drum 100, and starts an image forming operation.

In step S12, when the photosensitive drum 100 starts rotating, the electrostatic capacity detecting bias is applied to the supply roller 402.

In step S13, the switching operation control unit 1001 transmits the contact signal in a predetermined timing to cause the development device 400 to start the contact operation.

In step S14, the contact operation is started by the cam 700 and the contact time measurement unit 1002 starts measuring the contact time when the absolute value $|\Delta V|$ of amount of change detected by the electrostatic capacity detection device 410 exceeds the threshold Vth.

In step S15, the electrostatic capacity detecting bias is once turned off.

In step S16, an electrostatic latent image is formed to perform a development operation, and then the development operation for the last print job is ended.

In step S17, the electrostatic capacity detecting bias is applied again to the supply roller 402.

In step S18, the switching operation control unit 1001 transmits the separation signal in a predetermined timing to cause the development device 400 to start the separation operation.

In step S19, the separation operation is started by the cam 700 and the contact time measurement unit 1002 stops measuring the contact time when the absolute value $|\Delta V|$ of amount of change detected by the electrostatic capacity detection device 410 exceeds the threshold Vth again.

In step S20, the electrostatic capacity detecting bias is turned off.

After that, the electrostatic capacity detecting bias is applied once again to the supply roller 402 in a predetermined timing after the developing roller 401 is completely separated from the photosensitive drum 100 and stops driving. The remaining amount of a toner in the development device 400 is detected by the electrostatic capacity detecting bias. In step S21, after the detection of remaining amount of a toner is ended, the photosensitive drum 100 is stopped to end the image forming operation.

After the image forming operation was ended, in step S22, the control unit 1000 confirms whether information about integrated value of contact time of the developing roller 401 is stored in the memory 407 of the process cartridge P. If the information about integrated value is stored therein (YES in step S22), the information about integrated value is read and temporarily stored in a flash memory (not illustrated) attached to the control unit 1000.

In step S23, the control unit 1000 adds the measurements of contact time of the developing roller 401 acquired during the present image forming operation process to an integrated value A of contact time of the developing roller 401 read from the memory 407, thereafter, the integrated value A of contact time of the developing roller 401 is overwritten again in the memory 407.

In step S24, if the information about integrated value of contact time of the developing roller 401 is not stored in the memory 407 (NO in step S22), the measurements of contact time of the developing roller 401 acquired during the present image forming operation process are written as the integrated value A of contact time of the developing roller 401. Thereby, the contact time and the integrated value thereof can be accurately calculated without providing new members using the electrostatic capacity detection device for detecting the remaining amount of a toner.

The following describes a control for changing image forming conditions based on the integrated value of the time during which the developing roller contacts the photosensitive drum 100 acquired by the above method.

The control unit 1000 determines the image forming conditions for the next printing based on the integrated value A of contact time in the memory 407 with reference to a table of the image forming conditions with respect to the integrated value of contact time. A relationship between the integrated value of contact time and the image forming conditions is described below.

Figure 5:
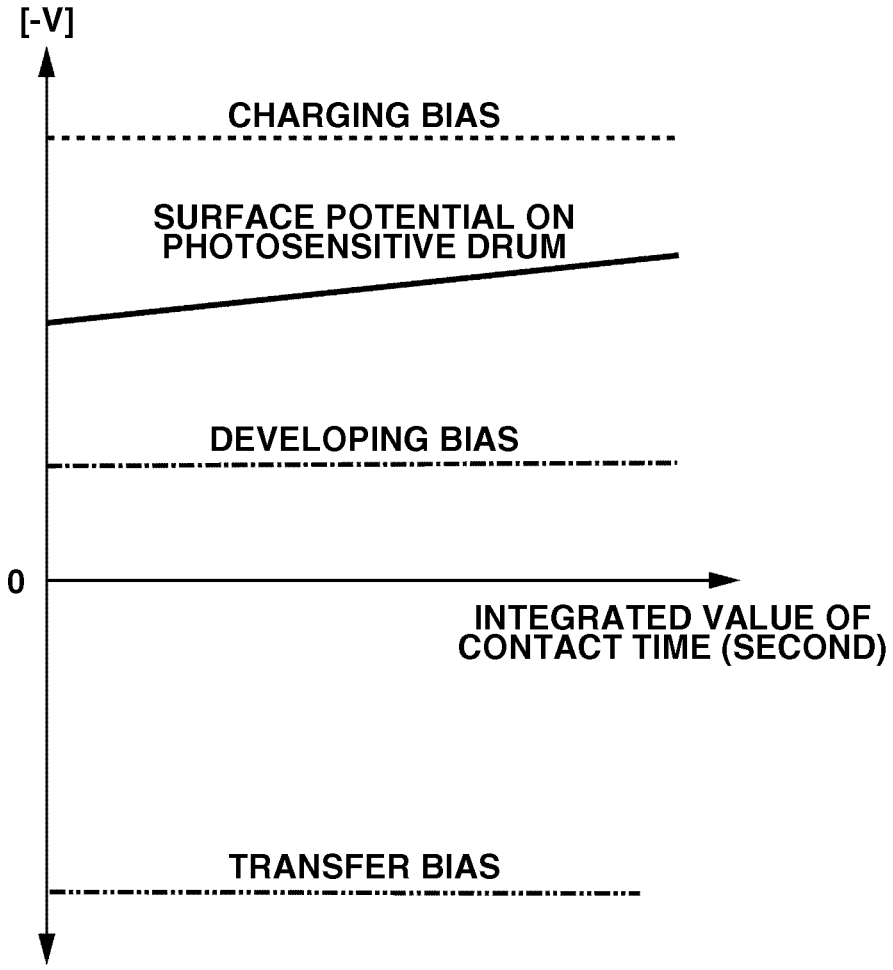
FIG. 5 illustrates transition in the surface potential on the photosensitive drum relative to the integrated value of contact time.

FIG. 5 illustrates transition in the integrated value of contact time, surface potential on the photosensitive drum 100, developing bias, and transfer bias in a case where a constant charging bias is applied. When the image forming apparatus is repetitively used, the surface of the photosensitive drum 100 wears down and the absolute value of the surface potential on the photosensitive drum 100 gradually increases if control is performed by the constant charging bias. This is because wear-down on the surface of the photosensitive drum 100 gradually increases the electrostatic capacity on the surface of the photosensitive drum 100. If an image is formed with constant developing and transfer biases until the photosensitive drum 100 reaches its lifetime, a difference between the surface potential on the photosensitive drum 100 and the developing bias or the transfer bias is gradually increased. This is liable to cause decrease in density and deterioration in image quality such as fogging and defective transfer just before the photosensitive drum 100 reaches its lifetime.

Figure 6A:
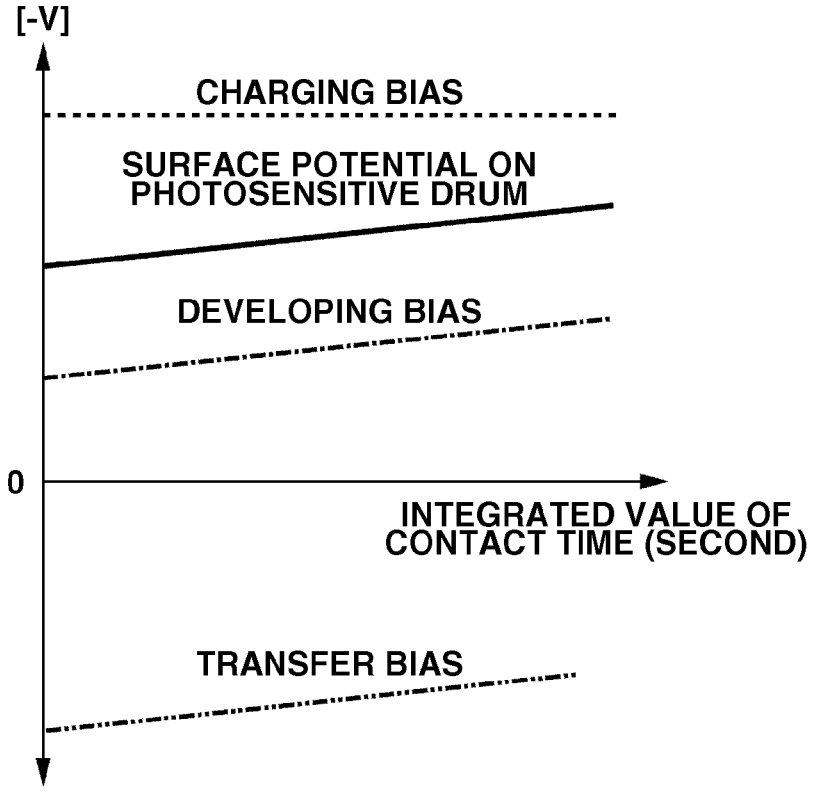
FIG. 6A is a schematic diagram representing image forming conditions in a case where a development bias and a transfer bias are changed based on the integrated value of the contact time.

As illustrated in FIG. 6A, the developing bias and the transfer bias are changed according to the integrated value of contact time to allow preventing the difference between the surface potential on the photosensitive drum 100 and the developing bias or the transfer bias from increasing. Thus, a good image can be acquired until the photosensitive drum 100 reaches its lifetime without causing the above deterioration in image quality. If a predetermined DC bias is applied to the core 402*a* of the supply roller 402 or a predetermined DC bias is applied to the developing blade 403 with a metallic blade used as the developing blade 403 to stabilize a charging characteristic of a toner, the DC bias applied to the core 402*a* or the developing blade 403 may change in conjunction with the developing bias. Similarly, various conditions may change such as various biases applied in the image forming operation and peripheral speed and timing of various members forming the image forming apparatus.

Figure 6B:
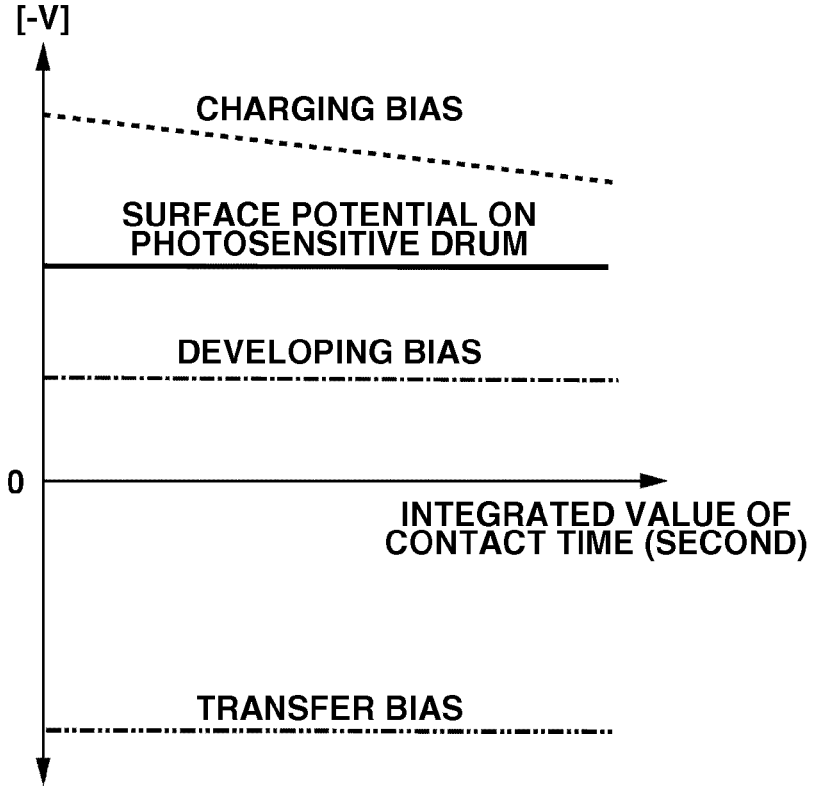
FIG. 6B is a schematic diagram representing image forming conditions in a case where a charging bias is changed based on the integrated value of the contact time.

The charging bias applied to the charging device 200 may be changed so that the surface potential on the photosensitive drum 100 is kept constant according to the integrated value of contact time. FIG. 6B illustrates transition in the integrated value of contact time, surface potential on the photosensitive drum 100, developing bias, transfer bias, and charging bias. When the image forming apparatus is repetitively used, the surface of the photosensitive drum 100 wears down and the absolute value of the surface potential on the photosensitive drum 100 gradually increases if control is performed by the constant charging bias as illustrated in FIG. 5. FIG. 6A illustrates the case where the developing bias and the transfer bias are changed along with the above gradual increase in the surface potential. In FIG. 6B, on the other hand, the absolute value of the charging bias is decreased so that the surface potential on the photosensitive drum 100 is kept constant. Even such a control can prevent a difference between the surface potential on the photosensitive drum 100 and the developing bias or the transfer bias from increasing. Thus, a good image can be acquired until the photosensitive drum 100 reaches its lifetime without causing decrease in density and deterioration in image quality such as fogging. In this case, other image forming conditions such as the developing bias described above do not need to be changed.

As described above, the image forming conditions are changed based on the time during which the developing roller 401 contacts the photosensitive drum 100 and which is accurately calculated using the electrostatic capacity detection device 410 for detecting the remaining amount of a toner so that a good image can be acquired until the photosensitive drum 100 reaches its lifetime.

The following describes a control for determining when to replace the photosensitive drum based on the integrated value of the time during which the developing roller contacts the photosensitive drum acquired by the above method.

The control unit 1000 compares the integrated value A of contact time in the memory 407 with a lifetime threshold B previously stored in the memory 407.

If the integrated value A of contact time reaches or exceeds the lifetime threshold B, a notification control unit 1003 generates a notification signal for notifying a user that the photosensitive drum 100 reaches its lifetime via an operation panel (not illustrated) or a PC display (not illustrated). If the integrated value A of contact time does not reach the lifetime threshold B, the main body of the image forming apparatus is ready to print and prepares for the next print job.

The lifetime threshold B of the photosensitive drum 100 is calculated by estimating the time during which the developing roller 401 contacts the photosensitive drum 100 to acquire the output image on one page with a certain size and multiplying the estimated time by the number of pages with the certain size regarded as the lifetime of the photosensitive drum 100. For example, if the time during which the developing roller 401 contacts the photosensitive drum 100 required for outputting an image on one page with an A4 size is 30 seconds and the number of A4-size pages which can be printed by the photosensitive drum 100 without any problem is 10000, the lifetime threshold B to be set is 300000 seconds.

Alternatively, if the notification control unit 1003 determines that the photosensitive drum 100 reaches its lifetime, the notification control unit 1003 not only notifies the user accordingly, but also may perform control to stop the operation of the main body of the image forming apparatus. This control can prevent various kinds of adverse effect caused when images are formed in excess of the lifetime of the photosensitive drum 100 (such as, reduction in quality of output image and the contamination and damage of the main body of the image forming apparatus due to leakage).

Furthermore, a previous-notice lifetime threshold C smaller in value than the lifetime threshold B of the photosensitive drum 100 may be set to issue a previous notice that the photosensitive drum 100 reaches its lifetime if the integrated value A of contact time of the developing roller 401 reaches or exceeds the previous-notice lifetime threshold C. For example, if the previous-notice lifetime threshold C is set to 90% of the lifetime threshold B, at the time that the remaining lifetime of the photosensitive drum 100 reaches 10%, the user can be notified that the photosensitive drum 100 is close to the end of its lifetime. Thereby, the user can prepare for the replacement of the process cartridge P in advance.

As described above, the replacement timing of the photosensitive drum 100 is determined based on the time during which the developing roller 401 contacts the photosensitive drum 100 and which is accurately calculated using the electrostatic capacity detection device 410 for detecting the remaining amount of a toner so that the user can be notified of the exact replacement timing of the photosensitive drum 100.

Although the electrostatic capacity detection device 410 is used to measure the contact time and detect the remaining amount of a toner, it is not essential to detect the remaining amount of a toner to obtain the effect that the contact time is accurately measured.

Figure 7:
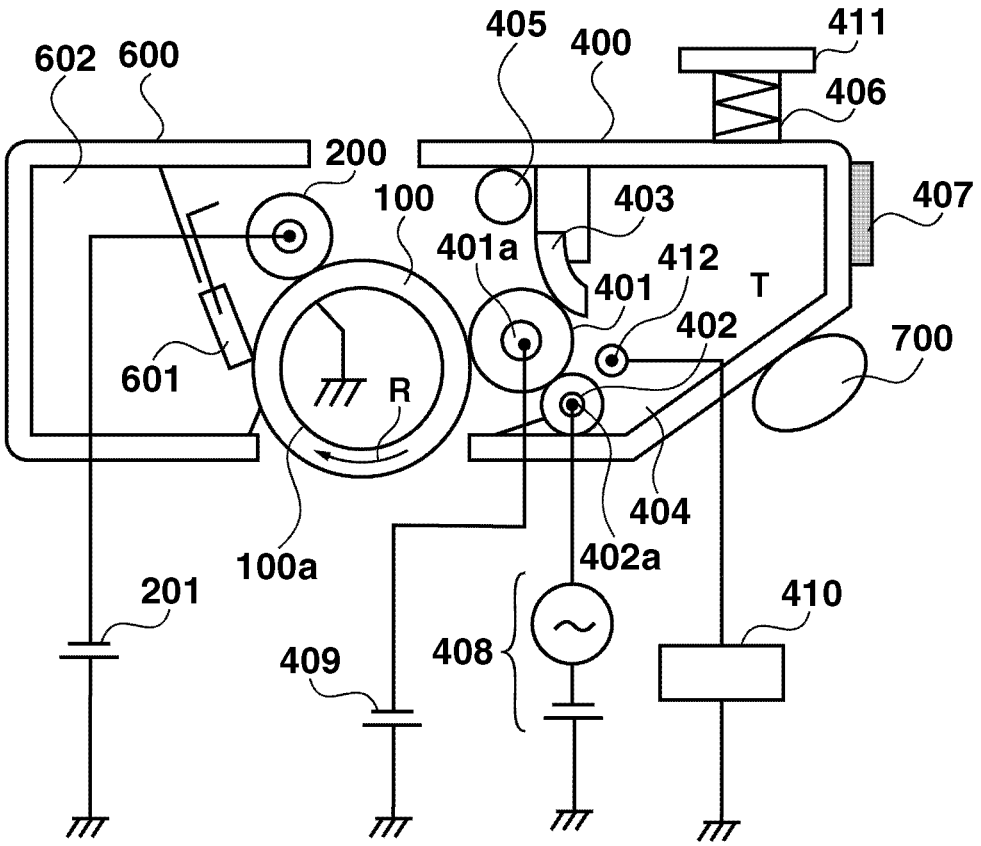
FIG. 7 is a schematic diagram representing a configuration in a case where current is detected from an electrode member according to the first exemplary embodiment of the present invention.

In the electrostatic capacity detection device 410 according to the first exemplary embodiment, an AC voltage is applied to the core 402*a* of the supply roller 402 to detect current flowing from the core 401*a* of the developing roller 401. However, the current flowing from a core 100*a* of the photosensitive drum 100 can be detected to measure the contact time. In this case, however, little current flows in the separation state, so that it is desirable to detect the remaining amount of a toner in the contact state. An electrode member 412 is arranged such that the electrostatic capacity between the electrode member 412 and the core 402*a* of the supply roller 402 is made different between the contact state and the separation state, to detect current flowing from the electrode member 412, thereby measuring the contact time. In this case, as illustrated in FIG. 7, if the electrode member 412 is located in the toner container, the remaining amount of a toner can also be detected. However, it is more desirable to detect the current flowing from the core 401*a* of the developing roller 401 or the core 100*a* of the photosensitive drum 100 rather than the electrode member 412 to measure the contact time accurately because the current flowing through the members used for contact and separation is directly detected and there is no need for adding a new electrode member. In the present exemplary embodiment, although the core 401*a* of the developing roller 401 is a first electrode member and the core 402*a* of the supply roller 402 is a second electrode member, the order of a first and a second electrode has nothing to do with the present invention. In the first exemplary embodiment, one of the first and second electrode members has only to be the core 401*a* of the developing roller 401, the core 100*a* of the photosensitive drum 100, or the electrode member 412 and the other thereof has only to be the core 402*a* of the supply roller 402.

In the first exemplary embodiment, although only the integrated value of the contact time is used as a parameter for determining the change of the image forming conditions and the replacement timing of the photosensitive drum 100, the change of the image forming conditions and the replacement timing of the photosensitive drum 100 may be determined in consideration of other parameters such as a charging voltage application time affecting the degree to which the photosensitive drum 100 wears down.

In the present exemplary embodiment, the electrostatic capacity detecting bias is applied to the core 402*a* of the supply roller 402. Thereby, the current flowing through the photosensitive drum 100 is smaller at the time of applying the same voltage than that in another exemplary embodiment as described later, in which the electrostatic capacity detecting bias is applied to the core 401*a* of the developing roller 401 or the core 100*a* of the photosensitive drum 100 at the time of measuring the contact time, which hardly causes current markings.

A second exemplary embodiment of the present invention is described below. With respect to the basic configuration of the main body of the image forming apparatus and the operation, description of a part which has in common with the first exemplary embodiment is omitted. In the first exemplary embodiment, the electrostatic capacity detecting bias is applied to the core 402*a* of the supply roller 402 and the current flowing from the core 401*a* of the developing roller 401 is detected to measure the contact time. In the second exemplary embodiment, the electrostatic capacity detecting bias is applied to the core 401*a* of the developing roller 401 and the current flowing from the core 402*a* of the supply roller 402 is detected to measure the contact time. The characterizing portions of the present exemplary embodiment are described below.

Figure 8A:
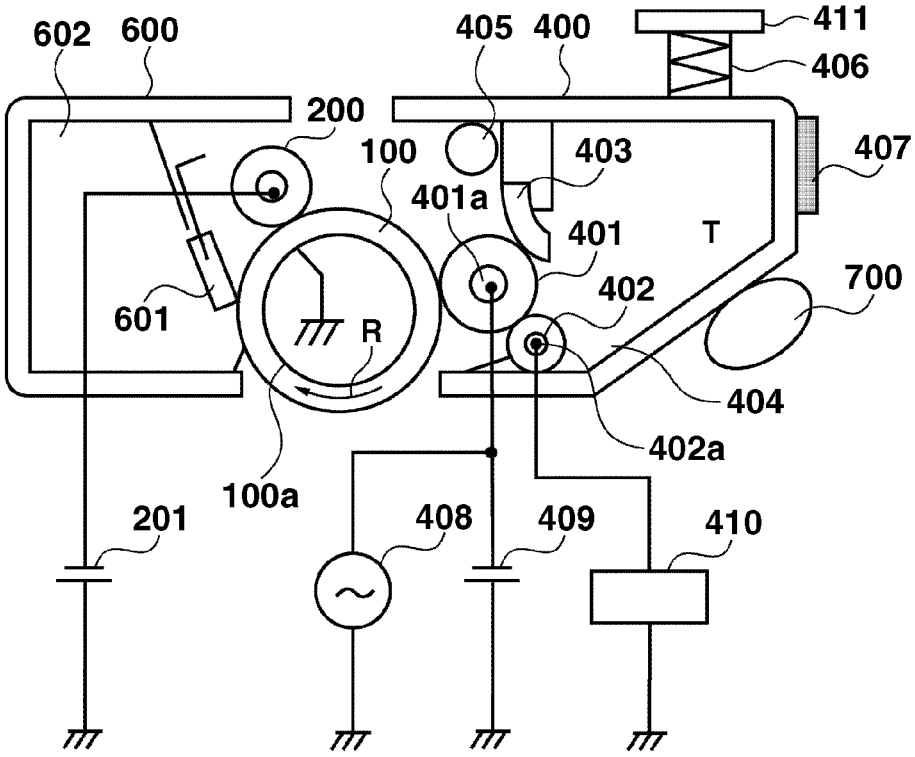
FIGS. 8A and 8B are schematic diagrams illustrating the contact state and separation state of a process cartridge according to a second first exemplary embodiment of the present invention respectively.
Figure 8B:
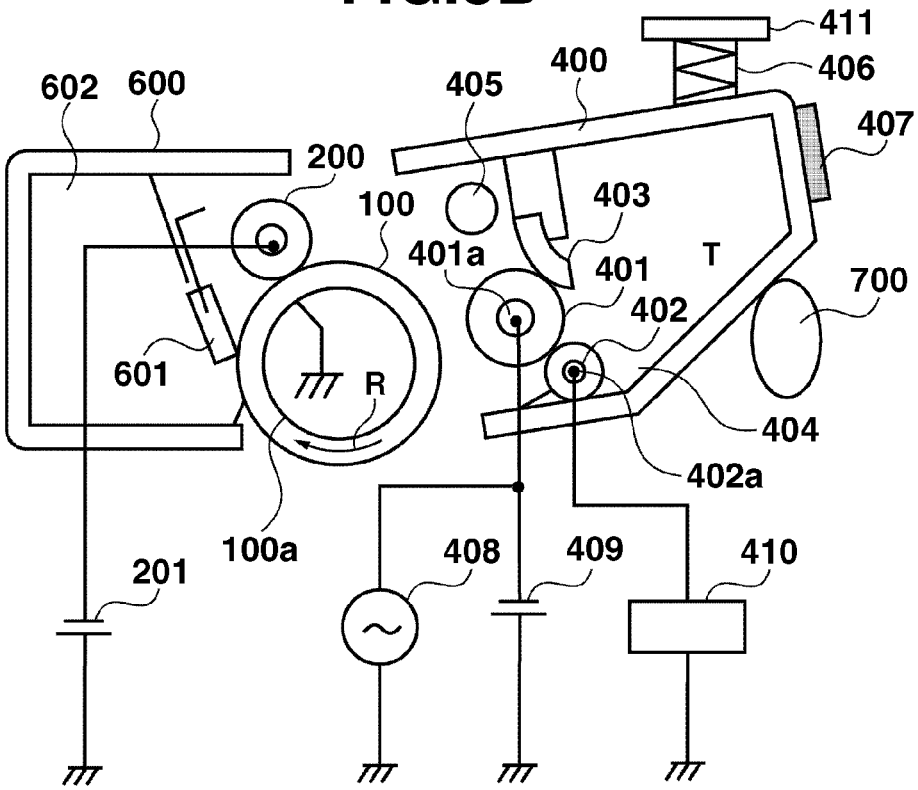

FIGS. 8A and 8B are schematic diagrams illustrating the contact state and the separation state of the process cartridge P in the present exemplary embodiment and schematically illustrate the electrical connection of the photosensitive drum 100, the charging device 200, and the development device 400.

In the present exemplary embodiment, a sine wave AC voltage with a frequency of 50 kHz and an amplitude of 200 V is applied to the core 401*a* of the developing roller 401 to detect the remaining amount of a toner. The bias at this point is the one for detecting the remaining amount of a toner. On the other hand, a sine wave AC voltage with a frequency of 50 kHz and an amplitude of 100 V is applied to the core 401*a* of the developing roller 401 to measure the time during which the developing roller 401 contacts the photosensitive drum 100. The bias at this point is the one for detecting the contact and the separation.

When the developing roller 401 is separated from the photosensitive drum 100 by applying an AC voltage great in amplitude and high in frequency to the core 401*a* of the developing roller 401, the electrostatic capacity between the photosensitive drum 100 and the conductive core 401*a* can transiently change. The occurrence of such a transient change causes the AC voltage to leak into the photosensitive drum 100, causing a leak marking on the surface of the photosensitive drum 100. If the leak marking occurs, a defective image such as a periodic horizontal streak image on the photosensitive drum 100 or damage on the main body of the image forming apparatus can be caused. Therefore, in the second exemplary embodiment, the amplitude and frequency of the AC voltage free from the above adverse effect are used at the time of measuring the time during which the developing roller 401 contacts the photosensitive drum 100.

If the amplitude and frequency of the AC voltage are small and low at the time of detecting the remaining amount of a toner, the value detected by the electrostatic capacity detection device 410 is reduced, so that more accurate detection of the remaining amount of a toner tends to be difficult. Accordingly, as described above, the amplitude and/or the frequency of the contact and separation detection bias are set to a value smaller than the bias for detecting the remaining amount of a toner, so that the above problem is avoided. Even if the electrostatic capacity detecting bias different between both states is used, the result of measuring the time during which the developing roller 401 contacts the photosensitive drum 100 and the result of detecting the remaining amount of a toner are independently used for control, so that there is no problem.

A sequence for measuring the contact time is similar to the one in the first exemplary embodiment, so that the description thereof is omitted. Thus, the contact time can be accurately calculated.

Control for changing the image forming conditions and determining the replacement timing of the photosensitive drum 100 based on the integrated value of the contact time is similar to the one in the first exemplary embodiment, so that the description thereof is omitted.

When the image forming conditions is changed based on the above integrated value of the contact time, a good image can be obtained until the photosensitive drum 100 reaches its lifetime. When the replacement timing of the photosensitive drum 100 is determined based on the above integrated value of the contact time, the user can be notified of the exact replacement timing of the photosensitive drum 100.

In the second exemplary embodiment, although the electrostatic capacity detection device 410 is used to measure the contact time and detect the remaining amount of a toner, it is not essential to detect the remaining amount of a toner to obtain the effect that the contact time is accurately measured.

In the electrostatic capacity detection device according to the second exemplary embodiment, the current flowing from the core 402*a* of the supply roller is detected, however, the current flowing from the core of the photosensitive drum 100 can also be detected to detect the electrostatic capacity. In this case, however, a unit for detecting the current flowing from the core 402*a* of the supply roller needs to be separately provided to detect not only the contact time but also the remaining amount of a toner.

The electrode member 412 is arranged such that the electrostatic capacity between the electrode member 412 and the core 401*a* of the developing roller 401 is different between the contact state and the separation state, so as to detect the current flowing from the electrode member 412 and also detect the electrostatic capacity. In this case, as illustrated in FIG. 7, if the electrode member 412 is located in the toner container, the remaining amount of a toner can also be detected.

In the second exemplary embodiment, although only the integrated value of the contact time is used as a parameter for determining the change of the image forming conditions and the replacement timing of the photosensitive drum 100, the change of the image forming conditions and the replacement timing of the photosensitive drum 100 may be determined in consideration of other parameters such as a charging voltage application time affecting the degree to which the photosensitive drum 100 wears down.

A third exemplary embodiment of the present invention is described below. With respect to the basic configuration of the main body of the image forming apparatus and the operation which are in common with the first and second exemplary embodiments, description is omitted. Although the electrostatic capacity detecting bias for detecting electrostatic capacity is applied to the core 402*a* of the supply roller 402 and the core 401*a* of the developing roller 401 in the first and second exemplary embodiments respectively, the third exemplary embodiment is characterized in that the AC voltage is applied to the core 100*a* of the photosensitive drum 100.

Figure 9:
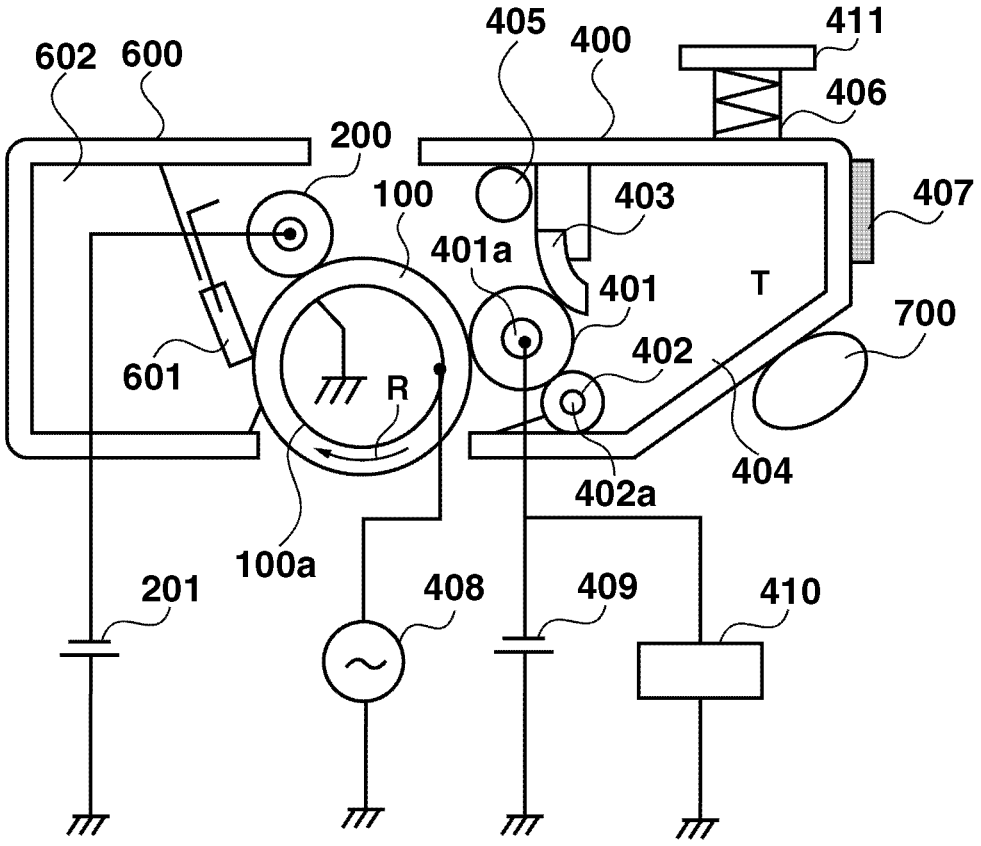
FIG. 9 is a schematic diagram representing a configuration in a case where current is detected from the core of the developing roller in a third exemplary embodiment of the present invention.

In the third exemplary embodiment, in a case where the AC voltage is applied to the core 100*a* of the photosensitive drum 100 to detect electrostatic capacity, the current flowing from the core 401*a* of the developing roller 401, the core 402*a* of the supply roller 402, or the separately provided electrode member 412 (which has only to be in the position where the electrostatic capacity between the electrode member 412 and the core 100*a* of the photosensitive drum 100 is different between the contact state and the separation state) is detected to measure the contact time. Of these, the case where the current flowing from the core 401*a* of the developing roller 401 is detected is illustrated in FIG. 9. The current needs to be detected in the toner container to know the remaining amount of a toner by detecting the current flowing from the core 402*a* of the supply roller 402 or the electrode member 412 provided in the toner container.

A sequence for measuring the contact time is similar to the one in the first exemplary embodiment, so that the description thereof is omitted.

Thus, the contact time can be accurately calculated.

Control for changing the image forming conditions and determining the replacement timing of the photosensitive drum 100 based on the integrated value of the contact time is similar to the one in the first exemplary embodiment, so that the description thereof is omitted.

By changing the image forming conditions based on the above integrated value of the contact time, a good image can be obtained until the photosensitive drum 100 reaches its lifetime. By determining the replacement timing of the photosensitive drum 100 based on the above integrated value of the contact time, the user can be notified of the exact replacement timing of the photosensitive drum 100.

A fourth exemplary embodiment of the present invention is described below. With respect to the basic configuration of the main body of the image forming apparatus and operation which are in common with the first to the third exemplary embodiment, description is omitted. Although the AC voltage for detecting electrostatic capacity is applied to the core 402*a* of the supply roller 402, the core 401*a* of the developing roller 401, and the core 100*a* of the photosensitive drum 100 in the first, the second, and the third exemplary embodiment, the fourth exemplary embodiment is characterized in that the AC voltage is applied to the separately provided electrode member 412 (which has only to be in the position where the abovementioned electrostatic capacity is different between the contact and the separation state).

Figure 10:
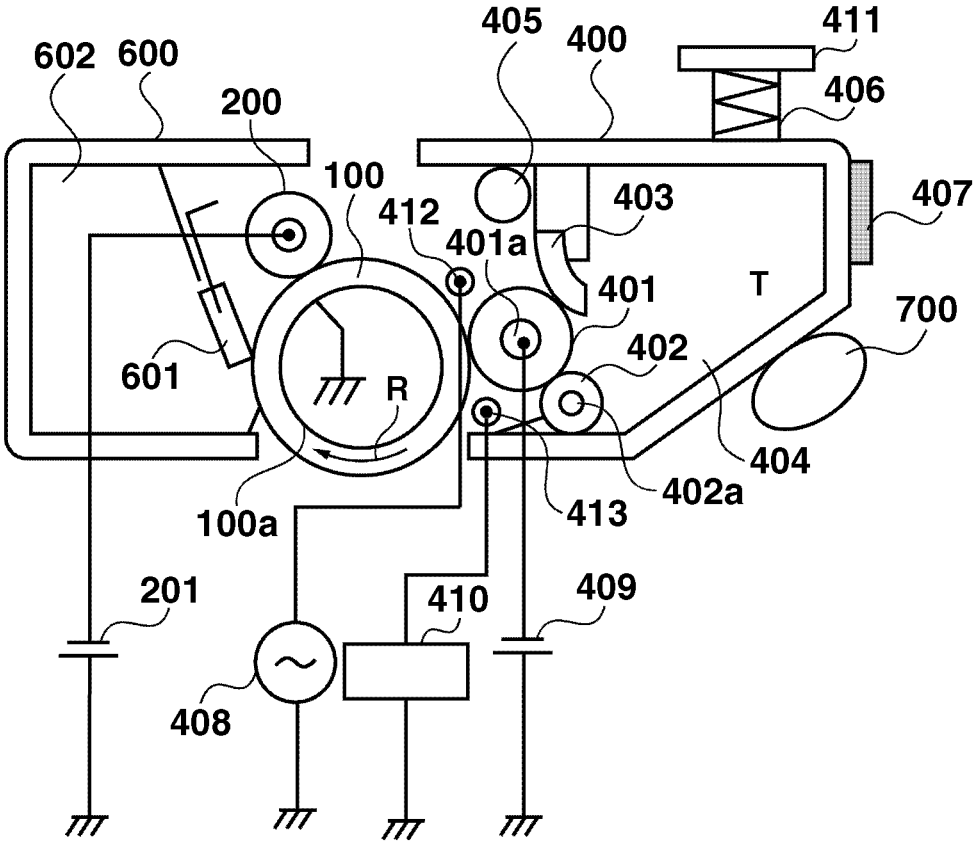
FIG. 10 is a schematic diagram representing a configuration in a case where current is detected from an electrode member according to a fourth exemplary embodiment of the present invention.

In the fourth exemplary embodiment, in a case where the electrostatic capacity detecting bias for detecting electrostatic capacity is applied to the conductive electrode member 412, the current flowing from the core 100*a* of the photosensitive drum 100, the core 401*a* of the developing roller 401, the core 402*a* of the supply roller 402, or a conductive electrode member 413 separately provided is detected to measure the contact time. Of these, the case where the current flowing from the separately provided electrode member 413 is detected is illustrated in FIG. 10 as a configuration example. The electrode member 412 has only to be located in the toner container to detect the remaining amount of a toner. In a case where the electrode member 412 is located outside the toner container, however, the current needs to be detected inside the toner container by detecting the current flowing from the core 402*a* of the supply roller 402 or the electrode member 413 provided inside the toner container.

A sequence for measuring the contact time is similar to the one in the first exemplary embodiment, so that the description thereof is omitted.

The contact time can be accurately calculated by the above configuration.

Control for changing the image forming conditions and determining the replacement timing of the photosensitive drum 100 based on the integrated value of the contact time is similar to the one in the first exemplary embodiment, so that the description thereof is omitted.

By changing the image forming conditions based on the integrated value of the contact time, a good image can be obtained until the photosensitive drum 100 reaches its lifetime. By determining the replacement timing of the photosensitive drum 100 based on the integrated value of the contact time, the user can be notified of the exact replacement timing of the photosensitive drum 100.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-093356 filed Apr. 14, 2010, which is hereby incorporated by reference herein in its entirety.

What is claimed is:

1. An image forming apparatus comprising:

an image carrier configured to carry an electrostatic latent image;

a toner carrier configured to carry a toner and develop the electrostatic latent image;

a switching member configured to perform a switching operation between a contact state where the toner carrier contacts the image carrier and a separation state where the toner carrier is separated from the image carrier;

a first electrode member;

a second electrode member arranged such that an electrostatic capacity between the first and second electrode members in the contact state is different from the electrostatic capacity therebetween in the separation state; a detection device configured to detect the electrostatic capacity between the first and second electrode members; and a measurement unit configured to measure a time during which the image carrier contacts the toner carrier, wherein the measurement unit starts the measurement when the electrostatic capacity changes exceeding a predetermined value along with the switching operation from the separation state to the contact state, thereafter, the measurement unit stops the measurement when the electrostatic capacity changes exceeding a predetermined value along with the switching operation from the contact state to the separation state.

2. The image forming apparatus according to claim 1, wherein one of the first and second electrode members is a core of the image carrier or a core of the toner carrier.

3. The image forming apparatus according to claim 2, further comprising a toner supply member configured to supply a toner to the toner carrier, wherein the other of the first and second electrode members is a core of the toner supply member.

4. The image forming apparatus according to claim 3, further comprising a toner container configured to contain the toner and include an opening, wherein the one of the first and second electrode members is a core of the toner carrier arranged in the opening, the toner supply member is provided inside the toner container, information about the remaining amount of a toner inside the toner container is detected based on the electrostatic capacity detected by the detection device.

5. The image forming apparatus according to claim 4, wherein the detection device detects the electrostatic capacity by applying a voltage with an AC component to the core of the toner supply member and detecting a current flowing from the core of the toner carrier.

6. The image forming apparatus according to claim 4, wherein the detection device detects the electrostatic capacity by applying a voltage with an AC component to the core of the toner supply member and detecting a current flowing from the core of the toner supply member, at least one of the amplitude or the frequency of the AC component is smaller at the time of measuring a time in the contact state than at the time of detecting information about the remaining amount of a toner.

7. The image forming apparatus according to claim 1, further comprising a notification control unit configured to perform control for sending a notification of information about replacement timing of the image carrier based on an integrated value of the time.

8. The image forming apparatus according to claim 1, wherein image forming conditions are changed based on an integrated value of the time.

* * * * *